United States Patent [19]

Seragnoli

[11] 3,979,881

[45] Sept. 14, 1976

[54] DEVICE FOR SEALING CIGARETTE PACKETS

[75] Inventor: Enzo Seragnoli, Bologna, Italy

[73] Assignee: G. D. Societa per Azioni, Bologna, Italy

[22] Filed: June 24, 1975

[21] Appl. No.: 589,878

[30] Foreign Application Priority Data

July 10, 1974 Italy ..... 3438/74

[52] U.S. Cl. ..... 53/77; 53/379; 156/359; 156/583

[51] Int. Cl.[2] ..... B65B 51/14

[58] Field of Search ..... 53/379, 373, 203, 229, 53/329, 77, 375; 156/359, 583, 358, 306

[56] References Cited

UNITED STATES PATENTS 3,431,398 3/1969 Wahle ..... 53/379 X 3,692,611 9/1972 Kühnle ..... 156/358

*Primary Examiner*—Othell M. Simpson
*Assistant Examiner*—Horace M. Culver
*Attorney, Agent, or Firm*—Robert E. Burns; Emmanuel J. Lobato; Bruce L. Adams

[57] ABSTRACT

A device for controlling the sealing of thermoplastic overwraps, particularly sealing end flaps of the overwraps on packets of cigarettes. At various speed levels of the overwrapping machine the time devoted to this sealing operation is kept constant. This is achieved by providing a plurality of control cams, the number of which corresponds to the number of speed levels there are on the machine. Each control cam operates at one of the speed levels, to periodically activate and deactivate sealing contrivances which operate on the ends of the packet.

8 Claims, 2 Drawing Figures

DEVICE FOR SEALING CIGARETTE PACKETS

BACKGROUND OF THE INVENTION

This invention relates in general to wrapping or packaging machines and, in particular, to what are known as overwrapping machines, that is to say, to machines whose task is to wrap in sheets of transparent paper, products previously packed in wraps that are essentially parallelepiped in shape.

DESCRIPTION OF THE PRIOR ART

For reasons of hygiene, as well as to render their appearance more pleasing, packets of cigarettes are wrapped and sealed, usually in sheets of transparent material on overwrapping machines.

This is generally done using the style of wrap known as the "soap" style and according to the known art, the hermetic sealing of this calls for sealing operations on one longitudinal side and on the two opposite ends of each packet.

The classic wrapping materials used on machines that overwrap the aforementioned products consist of a transparent viscous support on both sides of which there is a layer of fluid resistant lacquer, such as, for example, the material marketed under the trade mark "Cellophane."

Insofar as such materials are concerned, the sealing operations is performed by applying solvent or adhesive in the given areas, or through a heatsealing process to which only the outer layers of lacquer are subjected.

For some time now, however, increasing use has been made on the overwrapping machines of a different plastic, heat-sealing wrapping material produced with an extrusion process (polypropylene), such as, for example, that marketed by HERCULES, Inc., Wilmington, Del. under the name "Hercules" which, in comparison with the materials mentioned earlier on, offers numerous advantages.

This Hercules material can be obtained in webs of a gage notably less than that of materials of traditional type and since it is, in itself, already impervious to moisture, it does not have to be given any costly lacquering treatment.

Besides being a financially attractive proposition, when this Hercules material is used on overwrapping machines in reels of the same size as for "Cellophane," it lasts much longer than the latter.

The use of this Hercules material on known machines in accordance with traditional methods can, however, cause certain difficulties to arise.

This Hercules type of heat-sealing wrapping material for which no solvents or adhesives are used requires, in fact, the temperature to be controlled with precision during the sealing operation. This is because the working temperature for heatsealing polypropylene (approximately 125°–165°C) is more limited than is the case with "Cellophane" (approximately 180°–260°).

Aside from the temperature limits various problems are encountered. They include the phenomenon of the material shrinking considerably and of the consequential formation of ugly folds which, in the case of packets of what are called the "soft cup" type, cause crushing because of the contraction the overwrap undergoes.

According to what is known, the temperature reached in the areas affected by the seasling operation depends, subject to the temperature of the sealing contrivances and to the pressure exerted by them in the affected areas being equal, on the duration of the contact time.

In the particular case of overwrapping machines for the use described above which, as is known, operate at different running speeds, the contact time is chosen and fixed in a way in which to achieve fully successful sealing operations at the rated speed of the overwrapping machine.

The sealing contrivance generally takes its movement from the same devices that power the overwrapping machine. Therefore any possible variation in the working rhythm of the overwrapping machines gives rise to a variation in the contact time between the sealing contrivances and the outer wrap. This in turn tends to change the sealing temperature.

In the extreme case of the overwrapping machine coming to a stop, it is known to provide for automatic removal of the sealing contrivances away from the area in which they operate. It is necessary also to prevent the packets, with which the sealing contrivances come into contact, from getting burnt when the machine operates, for example when starting up or in cases of emergency, at speed levels below the rated speed. The increased time the plastic material is in contact with the sealing contrivances can bring about the difficulties mentioned above.

In order to overcome trouble of this nature, the idea is already known of controlling the sealing of wraps made of thermoplastic material on overwrapping machines, for example on packets of cigarettes in succession along a wrapping line, at different operating speed levels in a plurality of stations in which sealing contrivances are installed, by varying, as changes occur in the running speed of the overwrapping machine and consequentially in the contact time between the thermoplastic wrapping material and the sealing contrivances, the heat source of the sealing contrivances. For this purpose these contrivances may incorporate a plurality of electrical resistors sized to suit the various speeds at which the machine can operate, so that they can be switched in at the operating position when a change in the operating speed of the machine occurs.

Again with a view to overcoming the difficulties on overwrapping machines of the aforementioned type on which the sealing contrivances are connected to means that cause them to operate with a reciprocating motion, the idea is also known whereby instead of varying the heat source as changes take place in the running speed of the machine, both the heat source and the contact time between the thermoplastic wrapping material and the sealing contrivances are maintained constant by having a device for controlling the movement of the sealing contrivances connected to the mechanism provided for changing over the speed at which the machine is running and able to either prolong or curtail the operation of the sealing contrivances.

For this, a sealing contrivance control device is particularly known which has one single cam operating in conjunction with a device for controlling the operating time differentiation of this cam, connected to a device that is sensitive to variations in the speed of the machine.

From what has briefly been stated, it is quite clear that the electrical circuit for the above device is extremely complicated, particularly to secure the efficiency the sealing devices are expected to have when used in conjunction with very high output speed overwrapping machines (such as, for example, the machine made by the Assignees hereof, known commercially as the "CELL-PACK"). Under such conditions it is, in fact, awkward to control with precision the time destined to perform the sealing operation as a function of the frequent variations in the speed level.

SUMMARY OF THE INVENTION

The primary object of the present invention is, therefore, to make available a device for controlling the sealing of wraps made of thermoplastic material, which, for each speed level of the machine, provides mechanical type control means for maintaining constant the time destined for the sealing operation, the control means being identical in number to the number of speed levels of the machine, and being destined to operate individually for each of the speed levels.

This and other objects too have all been attained with the device according to the invention for controlling the sealing of wraps made of thermoplastic material, particularly on machines that overwrap, for example, packets of cigarettes in succession along a wrapping line at different operating speed levels, in a plurality of stations in one or more of which are installed sealing contrivances connected to means that cause them to operate with a reciprocating motion. According to the invention the means for operating the sealing contrivances terminate at one single control means for all speed levels. Selector means are provided which are connected to means sensitive to variations in the speed level and which work in conjunction with the operating means destined to be positioned at a point where the operating means applicable to the operating speed level of the machine are located, so that the time required for the sealing operation stays constant.

DESCRIPTION OF THE PREFERRED EMBODIMENT

Figure 1:
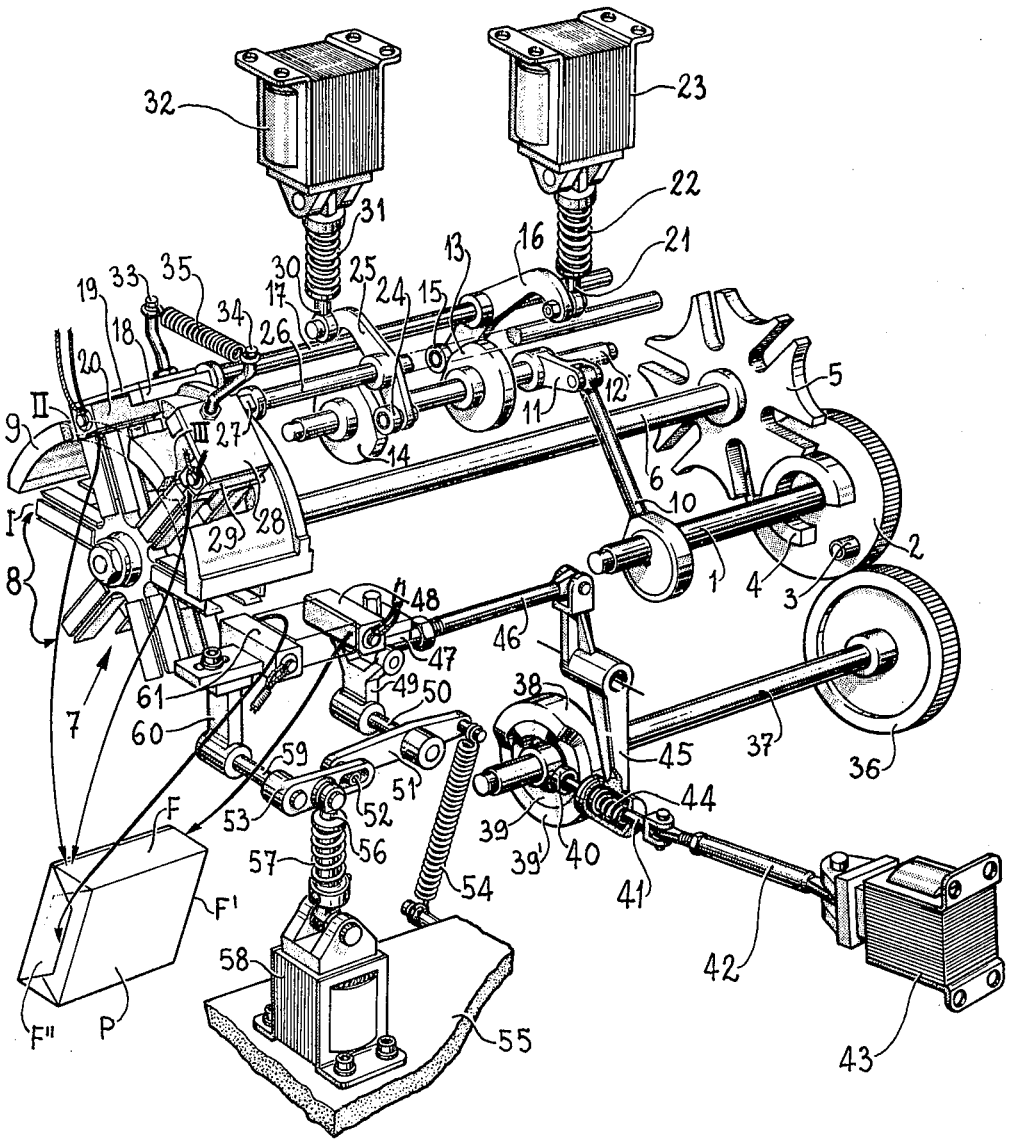
FIG. 1 shows diagrammatically, in a perspective view, the wrapping line of an overwrapping machine with the devices for sealing, and particularly for controlling the sealing, in accordance with the present invention, of the two ends of the outer wrap of each packet.

With particular reference to FIG. 1 and in accordance with the description given in copending patent application Ser. No. 589,879 of the assignees hereof, at 1 there is a horizontal drive shaft for the entire overwrapping machine and for the present device in this machien.

The shaft 1 has keyed onto it a gearwheel 2 and on one side of this, diametrically opposed to each other, are fixed a pin of idle roller 3 and an arcuate member or centering device 4.

These members 3 and 4 bring about the intermittent movement of a six compartment Geneva mechanism 5 rigidly mounted on a horizontal shaft 6 to the front end of which is fixed a packet-transferring means comprising a wrapping wheel 7. This wheel accordingly completes one forward movement or step 60° clockwise, followed by a halt, each time the shaft 1 makes one counterclockwise turn.

The wrapping wheel 7 has six radial compartments 8. When one of these, at a halt of Geneva mechanism 5 and wheel 7, is at a first station I, a packet P of cigarettes is inserted therein, on edge with respect to the axis of wheel 7, along with a sheet of transparent material for the formation of the outer wrap.

The wrapping material is then folded onto external surfaces of the packet by stationary and movable folding members, now shown in full. A guide 9 delimitates the upper part of the wheel 7 for approximately 180°.

An end of a connecting rod 10 is shown as secured to a sleeve 10′ which surrounds an eccentric disc 10″ secured to shaft 1. The other end of rod 10 is pivotally fastened to one extremity of a lever. The other extremity of the lever is secured to a shaft 12 parallel with the shaft 1, and, oscillating the shaft around its axis.

From right to left, looking at FIG. 1, the shaft 12 has keyed onto it first and second cams 13 and 14; they and the parts controlled thereby are more fully described in the copending application. These parts include;

An idle roller 15 at one end of a two armed lever 16 pivoted to a shaft 17 parallel with the shaft 12; a horizontal bar 18 fixed to the lefthand far end of the shaft 17 to support a rectangular plate 19, which supports a first electrically heated sealing member 20. The extremity of the second arm of the two armed lever 16 is connected to the lower end of a vertical rod 21 integral with the keeper of an electromagnet 23 and biased downwardly by a spring 22.

In exactly the same way as described in respect of the first cam 13, and its associated devices 15 to 23 the second cam 14 has corresponding, associatd devices 24 to 32, as shown.

Fixed onto the heater supporting plate 19 and 28 are bars 33 and 34, respectively, the upper ends of which are connected to each other through a spring 35 which is under tension and offsets the action of the electromagnets 23 and 32.

Under normal operating conditions, that is to say, when the overwrapping machine is running at its rated speed, which is its second speed, the sealing of the side F on the transparent thermoplastic wrap takes place for each packet, as more fully described in the copending application, in two separate phases, namely, an initial phase in station II performed by the first sealing member 20 and then a final phase, performed by the second sealing member 29 in station III, for sufficiently long a contact time to allow the operation to be carried out perfectly.

If overwrapping machine is operating, by contrast at a value below its rated speed, the total contact time between the surfaces of the sealing members 20, 29 and the individual sheets of transparent material on packets P is lengthened to the extent that it gives rise, bearing in mind the restricted temperature limits permissible for the materials under consideration, to the various annoyances described in the opening paragraphs.

For this reason the electrical control circuit for the overwrapping machine is set in such a way as to cut off one of the two sealing members through the automatic drop out of the respective electromagnet 23 or 32, when slow running is experienced.

In, the event of the overwrapping machine coming to a stop both electromagnets 23 and 32 drop out automatically and thus the sealing members 20, 29 are lifted away from the areas in which they work.

After the operation of sealing the longitudinal side has been performed in the way described in the cited patent application Ser. No. 589,879 seams or areas on the two ends on each packet still have to be sealed in order to complete the sealing of the outer wrap of packet P. This is done after the packets of cigarettes have been transferred from the wheel 7 to an exiting station or channel, by means in accordance with methods forming the subject of the present invention.

Through the gearwheel 2, the drive shaft 1 rotates a gear 36 keyed onto a shaft 37 parallel with the shaft 1, the lefthand far end of the former being integral with a cam 38, on the front side of which there are two tracks, 39 and 39′, respectively, which are concentric with respect to the shaft 37.

Assuming now that the overwrapping machine is running at its rated speed, the inner track 39 has running over it an idle roller 40 mounted on a horizontal rod 41. This rod is connected, via a rod 42, to the keeper of an electromagnet 43 which is normally in a state of excitation during such running.

The rod 41 passes its movement, derived via the roller 40 from the cam 38, onto a two armed lever 45. This lever is pivoted to a horizontal shaft, indicated by a broken line and which may be integral with the bedplate of the overwrapping machine. At a point corresponding to where it has a spring 44 enclosed around it, the rod 41 passes into a hollow end 45′ of one of the arms of the two armed lever 45, in such a way that it is able to slide axially from left to right with respect to the hollow end. This takes place, in the case of the electromagnet 43 being de-energized by, the action of the spring 44, the two ends of which are connected to the rod 41 and to the extremity of the two armed lever 45, respectively. In the considered case of the machine operating at its rated speed, and of electromagnet 43 being energized, spring 44 is stretched.

The second arm of the two armed lever 45 is connected, through a rod 46, to a block 47 for supporting an electrically heated sealing member 48 for a seam on the rear end F1 of packet P.

The block 47 is also connected, through a lever 49, to a horizontal shaft 50 parallel with an exiting channel of wheel 7. Shaft 50 serves as a pivot for a two armed lever 51 with which it is integral or to which it is secured, as shown.

The front arm (on the left looking at FIG. 1) on the two armed lever 51 is provided with a pin 52 which is horizontal and is inserted in a slot in one end of a lever 53. The rear arm is connected, via a spring 54, to a plate 55 integral with the bedplate of the overwrapping machine.

The lever 53 is pivoted, at an intermediate point, to the upper extremity of a vertical shaft 56 connected to the keeper of an electromagnet 58 mounted on the bed plate 55. The lever is biased upwardly by a spring 57 against a downward force applied to the lever when the electromagnet 58 is excited.

The second extremity of the lever 53 is integral with a shaft 59 parallel with the shaft 50 and integral with a block 60 for supporting an electrically heated sealing member 61 for a seam on the front end F2 of packet P.

Through the described mechanical connections, the cam 38 causes the sealing members 48 and 61 to simultaneously approach, in a direction crosswise to the exiting channel and during each of the two halts, of Geneve mechanism 5 and wheel 7 the ends F1 and F2, respectively, on each packet P of cigarettes, and then to move away therefrom at the time the packet is moving forward through the exiting channel.

When the machine is being started up, or for some emergency reason is running at a speed below its rating, the electromagnet 43 is, as can be seen from the wiring diagram in FIG. 2, automatically de-energized.

As a consequence of the pull exerted on the rod 41 by the spring 44, the idle roller 40 is carried onto the outer rack 39′ of the cam 38. On this outer track 39′, a raised section, shown on top and causing, through linkage 45 to 60, the sealing members 48 and 61 to be moved away from their respective operating areas, extends for a greater number of degrees than is the case with the inner track 39. Because of this, despite the slower running speed of the machine and thus of the devices that drive the mechanism 36, 37, 38 according to the present invention, the time for the operation of sealing the ends F1 and F2 on the outer wrap of each packet remains constant, as required for the particular type of wrapping material under consideration.

Finally, in the case of a stoppage on the part of the overwrapping machine, to prevent damage occurring to the packet positioned on the exiting channel at a point where the sealing of its ends takes place, the electromagnet 58 is automatically de-energized to allow, under the pull of the spring 54 and the push of the spring 57, the two sealing members 48 and 61 to be simultaneously moved away from the ends F1 and F2, respectively, by rotating them around the shafts 50 and 59, respectively, into a non-operative position.

Figure 2:
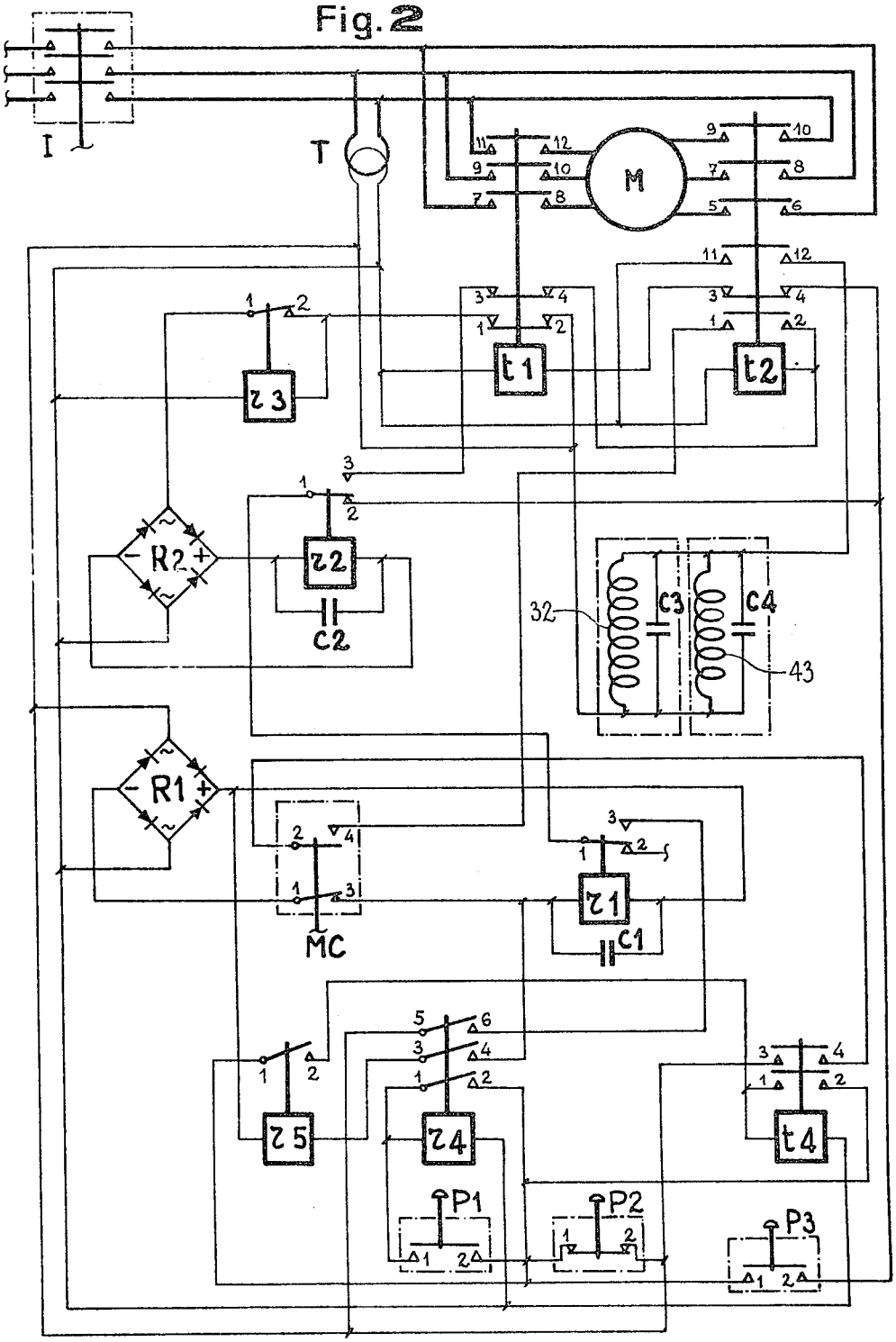
FIG. 2 shows diagrammatically the electrical control circuit for the overwrapping machine in FIG. 1.

Reference should now be made to FIG. 2 in which the electrical circuit is shown for the motor M of drive shaft 1 and for the principal electromagnets. As envisaged in the copending patent application, a microswitch MC is provided. It is positioned at a point where the packets of cigarettes to be overwrapped enter the overwrapping machine. At the "first speed" of the machine this microswitch has its contacts 1–3 closed and its contacts 2–4 open, whereby a relay *r*1 for a "first speed" timer is energized with direct current from a rectifier R1 through the closed contacts 1–3 of the microswitch MC.

A relay *r*3 is energized through a normally closed pair of contacts 1–2 of a contactor *t*1. Thus, through a pair of contacts 1–2 of relay *r*3 and the pair of contacts 1–2 of contactor *t*1 current is sent to a current rectifier R2 which excites a relay *r*2 for a second speed timer.

Under these conditions, the motor M for operating the overwrapping machine is at a standstill.

When a manual pushbutton P1 is pressed, a relay *r*4 is excited through a manual pushbutton stop switch P2 and the relay stays self-excited through its pair of contacts 1–2 and the pushbutton stop switch P2. The excitation of the relay *r*4 causes, through its pair of contacts 3–4 and the contacts 1–3 of the microswitch MC, a relay *r*5 to be energized and to be supplied with direct current from the current rectifier R1.

The excitation of the relay *r*5 brings about, through its contacts 1–2 and the stop switch P2, the energizing of a contactor *t*4 which stays self-excited through its pair of contacts 1–2 and the stop switch P2.

When the packets to be fed to the overwrapping machine reach the microswitch MC they change over the position of its contacts from 1–3 closed and from 2–4 open.

At a time preset by a capacitor *c*1, this changeover causes the relay *r*1 to drop out and thus, through the pair of contacts 5–6 of the relay *r*4, self-excited as seen earlier on, the pair of contacts 1–3 of the relay *r*1 itself, the pair of contacts 1–2 of the energized relay *r*2 and the pairs of contacts 3–4 of the contact *t*2, to energize the contactor *t*1 and to set the motor M going at its first speed, through its pairs of contacts 7–8, 9–10 and 11–12.

With the excitation of the contactor *t1* its contacts 1–2 open and thus with the relay *r3* dropping out, the supply to the rectifier R2 ceases and, consequentially, at the time preset by a capacitor *c2*, the relay *r2* is de-energized. In this way the changeover occurs of the contacts of the relay *r2* from position 1–2 to position 1–3 which results in the contactor *t1* dropping out and the contactor *t2* being energized through the pairs of contacts 5–6 of the relay *r4*, 1–3 of the relay *r1*, 1–3 of the relay *r2* and 3–4 of the contactor *t1* itself.

The excitation of the contactor *t2* brings about the closing of its contacts 5–6, 7–8 and 9–10 and a change in the speed of the motor M from the first speed to the second speed, as well as the closing of the contacts 11–12, at the time preset by the capacitors *c3* and *c4*, respectively, of the electromagnets 32 and 43, respectively, for the activation of the sealing members 29 and, in conformity with the present invention, the activation of the sealing members 48 and 61.

What is claimed is:

1. A device for sealing seams of thermoplastic overwraps on packets, comprising;

packet-transferring means movable along a path at a plurality of operating speed levels subject to periodic halts, receptive during each halt at a first station of a packet and of a sheet of thermoplastic material for overwrapping the packet in the sheet and for providing a seam of the sheet on the packet, and having a sealing station spaced from the first station along the path, for sealing the seam;

a sealing contrivance located in a position adjacent the sealing station and mounted for movement into and away from contact with the seam;

a support for the sealing contrivance, for supporting it in said position and for effecting said movement; and a control cam having linkage for reciprocably shifting the support to effect said movement of the sealing contrivance during each halt of the transferring means, the cam having a plurality of cam surfaces corresponding to the plurality of speed levels, for effecting the shifting of the support so as to keep the time of contact of the sealing contrivances with the seam substantially constant regardless of the different operating speed levels of the packet-transferring means.

2. A device according to claim 1, in which the control cam has the cam surfaces disposed as concentric rings.

3. A device according to claim 2 in which the linkage of the control cam includes a cam follower roller shiftable into engagement with different ones of said rings, and means for shifting the roller into such engagement.

4. A device according to claim 3, in which the means for shifting the roller comprises an electromagnet for shifting the roller outwardly with respect to said rings, and a biasing spring for shifting the roller inwardly with respect to said rings.

5. A device according to claim 4 including circuit means for selectively energizing and deenergizing the electromagnet in response to changes of the operating speed level.

6. A device according to claim 4 including a second sealing contrivance and a second support for supporting it in the sealing station for movement into and away from contact with a second seam of the sheet on the packet, and a second electromagnet and a second bias spring and linkage means controlled thereby for moving and keeping both sealing contrivances out of contact with any packet in the sealing station when the wrapping wheel no longer rotates subject to its periodic halts.

7. A device according to claim 6 including means for providing the first-mentioned seam and the second seam on first and second ends, respectively, of each packet.

8. A device according to claim 7 in which the sealing station is located in an exit portion of the packet-transferring means.

* * * * *